US007815130B2

(12) United States Patent
Joseph et al.

(10) Patent No.: US 7,815,130 B2
(45) Date of Patent: Oct. 19, 2010

(54) RESERVOIR WITH REFILL INLET FOR HAND-HELD SPRAY GUNS

(75) Inventors: Stephen C. P. Joseph, Woodbury, MN (US); Michael J. R. Adams, Norfolk (GB); Antonio Bacciocchi, Gerenzano (IT); Malcolm F. Douglas, Swansea (GB); Daniel E. Siltberg, White Bear Township, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 130 days.

(21) Appl. No.: 11/549,285

(22) Filed: Oct. 13, 2006

(65) Prior Publication Data

US 2007/0131793 A1 Jun. 14, 2007

Related U.S. Application Data

(63) Continuation of application No. 10/475,397, filed as application No. PCT/US02/13165 on Apr. 24, 2002.

(30) Foreign Application Priority Data

Apr. 24, 2001 (GB) ..... 0110025.4

(51) Int. Cl.
*B05B 7/02* (2006.01)
*B05B 9/00* (2006.01)

(52) U.S. Cl. ..... 239/526; 239/379

(58) Field of Classification Search ..... 239/526, 239/346, 302, 309, 318, 327, 329, 345, 362, 239/590, 375–379, DIG. 14; 220/403, 404; 222/83, 95, 105

See application file for complete search history.

(56) References Cited

U.S. PATENT DOCUMENTS

| | | | |
|---|---|---|---|
| 1,703,384 | A | 2/1929 | Birkenmaier |
| 2,051,518 | A | 8/1936 | Cunningham |
| 2,228,861 | A | 1/1941 | Wegener |
| 3,066,872 | A | 12/1962 | Kobee |
| 3,227,305 | A | 1/1966 | Enssle |

(Continued)

FOREIGN PATENT DOCUMENTS

| | | | |
|---|---|---|---|
| CA | 2569369 | * | 7/1998 |

(Continued)

*Primary Examiner*—Davis Hwu
(74) *Attorney, Agent, or Firm*—Philip P. Soo

(57) ABSTRACT

A paint reservoir has a fluid outlet 115 connectable to a spray gun 101 and a fluid inlet 131 provided with a removable screw cap 132 whereby the fluid inlet 131 is directly accessible for introducing paint to the reservoir while attached to the spray gun 101. The fluid outlet 115 and fluid inlet 131 may both be provided in an end wall of the reservoir with outlet 115 located on the longitudinal axis of the reservoir or offset to allow the size of the fluid inlet 131 to be increased for easier filling of the reservoir. The outlet 115 can be aligned with the longitudinal axis of the reservoir or it can be inclined relative to the longitudinal axis to provide greater clearance for access to the fluid inlet 131 when the reservoir is attached to the spray gun 101. In an alternative arrangement, the fluid outlet is provided in an end wall of the reservoir and the fluid inlet is provided in a sidewall of the reservoir.

11 Claims, 18 Drawing Sheets

U.S. PATENT DOCUMENTS

| | | | | |
|---|---|---|---|---|
| 3,255,972 | A | | 6/1966 | Hultgren et al. |
| 3,570,499 | A | | 3/1971 | Ruta |
| 3,773,211 | A | | 11/1973 | Bridgman |
| 3,934,746 | A | | 1/1976 | Lilja |
| 4,035,004 | A | | 7/1977 | Hengesbach |
| 4,174,071 | A | | 11/1979 | Lau et al. |
| 4,559,140 | A | | 12/1985 | Croteau |
| 4,712,739 | A | | 12/1987 | Bihn |
| 4,781,311 | A | | 11/1988 | Dunning et al. |
| 4,930,644 | A | | 6/1990 | Robbins, III |
| 4,946,558 | A | | 8/1990 | Salmon |
| 4,951,875 | A | | 8/1990 | Devey |
| 5,069,389 | A | | 12/1991 | Bitsakos |
| 5,097,540 | A | | 3/1992 | Lovitt |
| 5,123,571 | A | | 6/1992 | Rebeyrolle et al. |
| 5,143,294 | A | | 9/1992 | Lintvedt |
| 5,211,289 | A | * | 5/1993 | Matthews ..... 206/508 |
| 5,307,994 | A | | 5/1994 | Hieronymus |
| 5,421,489 | A | | 6/1995 | Holzner, Sr. et al. |
| 5,447,110 | A | * | 9/1995 | Brown ..... 141/2 |
| 5,582,350 | A | | 12/1996 | Kosmyna et al. |
| 5,655,714 | A | | 8/1997 | Kieffer et al. |
| 6,027,041 | A | | 2/2000 | Evans |
| 6,053,429 | A | | 4/2000 | Chang |
| 6,536,684 | B1 | * | 3/2003 | Wei ..... 239/302 |
| 6,536,687 | B1 | | 3/2003 | Navis et al. |
| 6,595,441 | B2 | | 7/2003 | Petrie et al. |
| 6,820,824 | B1 | | 11/2004 | Joseph et al. |
| 7,188,785 | B2 | | 3/2007 | Joseph et al. |

FOREIGN PATENT DOCUMENTS

| | | |
|---|---|---|
| EP | 0 847 809 A1 | 6/1998 |
| JP | 6-335643 | 12/1994 |
| JP | 3052058 | 6/1998 |
| JP | 11-28394 | 2/1999 |
| WO | WO 98/32539 | 7/1998 |

* cited by examiner

RESERVOIR WITH REFILL INLET FOR HAND-HELD SPRAY GUNS

CROSS REFERENCE TO RELATED APPLICATIONS

This is a continuation of application Ser. No. 10/475,397, filed Apr. 24, 2002; which was a national stage filing under 35 U.S.C. 371 of PCT/US02/13165 filed Apr. 24, 2002, which International Application was published by the International Bureau in English on Oct. 31, 2002, which claims priority to GB 0110025.4, filed Apr. 24, 2001, the disclosure of which is incorporated by reference in their entirety herein.

FIELD

This invention concerns improvements in or relating to liquid spraying apparatus. The invention has particular, but not exclusive, application to hand held spray guns provided with a liquid reservoir for spraying a substrate.

BACKGROUND

Spray guns are widely used in vehicle body repair shops when re-spraying a vehicle that has been repaired following an accident. In the known spray guns, the liquid is contained in a reservoir attached to the gun from where it is fed to a spray nozzle. On emerging from the spray nozzle, the liquid is atomised and forms a spray with compressed air supplied to the nozzle. The liquid may be gravity fed, suction fed or, more recently, pressure fed by an air bleed from the compressed air source to the reservoir.

A typical paint finish may require application of a primer, base coat and top coat. The spray gun and reservoir have to be thoroughly cleaned when changing the liquid in the paint pot to avoid cross-contamination which may adversely affect the finish. This is especially important when spraying part of a vehicle to match exactly the colour of the existing colour of the adjacent bodywork.

Cleaning the spray gun and reservoir is time consuming and often requires the use of solvents that are costly and may present a health hazard to the operator. In order to reduce the amount of cleaning and to facilitate changeover from one liquid to another, we have previously proposed in WO 98/32539 an arrangement in which the liquid is contained in a collapsible reservoir that functions as a disposable lining for a paint pot.

In one construction, the reservoir comprises an open-ended container that is a close fit in the paint pot, and a separate lid that closes the open end of the container and has an outlet connectable to the spray gun. In use, the container collapses as the liquid is withdrawn and, after spraying, the container can be removed from the paint pot with the lid attached and thrown away. The paint pot can then be provided with a new, clean container for a different liquid to be applied as the next coat. As a result, the amount of cleaning required is considerably reduced and the spray gun can be readily adapted to apply different liquids in a simple manner.

With this arrangement, the reservoir has to be detached from the spray gun and the lid removed if it is desired to top-up the reservoir with more liquid. For example when painting a large area or applying several coats of the same liquid to the same or different vehicles such as when using a primer or lacquer finish. This is time consuming and can be messy if the liquid is spilt. Also, detaching the reservoir from the spray gun and removing the lid to add more liquid to the reservoir increases the risk of contamination from other sources, e.g. dust or dirt. Unwanted solid particles can be removed by the inclusion of a filter but this may become blocked and does not prevent the colour of the finish being adversely affected by any contaminants being absorbed into the liquid.

Another arrangement for lining a paint pot to reduce the amount of cleaning is disclosed in U.S. Pat. No. 5,582,350. In this arrangement, the paint is contained in a collapsible bag within the paint pot and is connectable via an outlet at one end of the pot to a spray gun. The other end of the pot is closed by a lid that is removable to provide access to the bag within the pot. The bag has a re-sealable zipper closure by means of which paint can be added to the bag. The bag is initially connected to the outlet while empty. Paint is then poured into the bag and the bag sealed before securing the lid to close the pot. On completion of spraying, the bag can be removed for disposal and replaced by a new clean bag. With this arrangement there is a risk of spillage if the bag is overfilled before fastening the zipper closure. Furthermore, if it is desired to add paint to the bag in use, access to the zipper closure is only possible if the lid is removed to open the pot. Moreover, a collapsed or partially collapsed bag may have to be extended before opening the zipper closure to add paint and the bag may be disconnected from the outlet. As a result, paint may leak from the bag necessitating cleaning of the pot when the bag is removed on completion of spraying. This arrangement is therefore generally only suitable for single use in which the bag is filled once on initial set-up of the spray gun and is not intended for re-filling the bag.

SUMMARY

The present invention is intended to improve further our existing system and provide additional benefits and advantages for the manufacturer and/or user.

More specifically, the present invention provides an apparatus for spraying a liquid contained in a reservoir wherein the liquid can be added to the reservoir without detaching the reservoir from the apparatus.

In addition the present invention provides a collapsible reservoir for connecting to spraying apparatus wherein the reservoir can be supplied empty or pre-filled with liquid.

The present invention also provides a collapsible reservoir for use with spraying apparatus which can be refilled in a simple manner while attached to the apparatus and is disposable after use to reduce the amount of cleaning required.

Other objects, benefits and advantages of the invention are referred to later herein.

According to a first aspect of the present invention, there is provided an apparatus such as a spray gun for spraying a liquid comprising a collapsible reservoir for a liquid to be sprayed, a spray nozzle for dispensing liquid supplied from the reservoir, the reservoir having a fluid outlet connectable to the apparatus and a fluid inlet for adding liquid to the reservoir, and the fluid inlet having a removable closure for opening and closing the fluid inlet, wherein the closure is directly accessible when the reservoir is connected to the apparatus.

By the provision of a separate fluid inlet with a removable closure that is directly accessible when the reservoir is connected to the apparatus, liquid can be added to the reservoir without removing the reservoir from the apparatus. This is of particular benefit if the capacity of the reservoir is less than the volume of paint required to paint a given area. Thus, when painting a large area, the user can simply top-up the reservoir with additional paint as required with the reservoir still attached to the apparatus. As a result, the risk of spillage and/or contamination of the paint is reduced. It is also of benefit when applying a finishing clearcoat such as lacquer where the addition of solvent to the reservoir to reduce the viscosity of the clearcoat for 'fading-out or blending' is made considerably easier.

Advantageously, the reservoir is adapted for releasable connection to the apparatus. For example, the reservoir and apparatus may be provided with co-operating formations for releasably securing the reservoir. The co-operating formations may be engageable with a push/twist action such as bayonet type formations. In this way, the reservoir can be connected to and released from the apparatus gun in a simple manner requiring minimum effort or manual dexterity by the user.

The reservoir may comprise a collapsible portion for the liquid to be supplied to the apparatus and an attachment portion provided with the fluid outlet for connecting the reservoir to the apparatus. For example, the collapsible portion may comprise a flexible container for the liquid and the attachment portion may comprise a lid arranged to close an opening in the container. Preferably, the container and lid are disposable and can be thrown away after use.

In one arrangement, the fluid outlet and fluid inlet are provided in the lid at one end of the reservoir, and the fluid inlet is constructed and arranged to be accessible when the reservoir is connected to the apparatus via the fluid outlet. In this way, the provision of the fluid inlet does not interfere with collapsing of the reservoir as the liquid is being withdrawn. Furthermore, by providing the fluid inlet and fluid outlet at the end of the reservoir, the apparatus can be arranged to position the fluid inlet to allow the reservoir to be substantially completely filled. In addition, the fluid outlet may be positioned above the level of the liquid in the reservoir. Moreover by having the fluid inlet in the lid, it may be possible to insert a rod or other tool for stirring the liquid in the reservoir thereby ensuring thorough mixing of the added liquid with any liquid remaining in the reservoir for continued spraying. Shaking is also possible to ensure thorough mixing.

The fluid outlet may be arranged on a central longitudinal axis of the reservoir but more preferably, the fluid outlet is offset to one side of the central longitudinal axis. The offset arrangement provides more room to accommodate the fluid inlet and allows the fluid inlet to be enlarged. In this way, filling the reservoir through the fluid inlet is facilitated with less risk of spillage and a removable filter can be positioned in the fluid inlet to filter the liquid as it is being introduced. As a result, it may not be necessary to provide a filter within the reservoir to filter the liquid as it is withdrawn from the reservoir through the fluid outlet thereby reducing the risk of the flow of liquid being restricted by blockages during spraying. The fluid inlet may be accommodated inwardly of the marginal edge of the lid or it may extend outwardly beyond the marginal edge.

The fluid outlet may extend parallel to the longitudinal axis of the reservoir but more preferably the fluid outlet is inclined relative to the longitudinal axis. Inclining the fluid outlet provides greater clearance between the apparatus and the fluid inlet so that access to the fluid inlet is improved when the reservoir is attached to the apparatus.

The lid may be separate from the flexible container and means provided for securing the lid to close the opening in the container. In one arrangement, the flexible container is a close fit in and provides a lining for an outer pot and the lid is releasably secured to the container by a engagement of a locking collar with the outer pot. In this way, the outer pot supports the flexible container and enhances stability of the reservoir when connected to the apparatus. Moreover, after use, the flexible container and lid may be thrown away and the outer pot retained for assembly with a new, clean flexible container and lid. As a result, the amount of cleaning required is reduced.

In another arrangement, the lid and flexible container may be bonded together by adhesive, welding or the like. Alternatively or additionally, the lid and flexible container may be mechanically secured together via engagement of interlocking formations or the like. In this way, the reservoir may be supplied empty for filling by the user via the fluid inlet or it may be pre-filled with a liquid ready for the user to attach to the apparatus. A cage or other form of external support may be provided for the flexible container to improve stability of the reservoir when attached to the apparatus.

Where the reservoir is supplied empty, it may be collapsed to a compact form for storage and transportation. Pre-filling may be employed for liquids that can be packaged and stored until required without degrading. Thus, pre-filling may be especially useful for liquids that can be supplied ready to use (i.e. without requiring modification to match the colour to an existing colour). For example, base coats in standard colours of a specified shade and/or primers or lacquers that can be supplied in a non-activated form and activated (if necessary) by suitable means such as by exposure to a source of light (ultraviolet) or electrical energy when required. Whichever arrangement is employed, the reservoir can be re-filled in use without detaching from the apparatus by the use of the fluid inlet.

In yet another arrangement, the lid has an end wall and a sidewall extending from the end wall, the sidewall being arranged to connect the lid to the flexible container either releasably or permanently as described above. With this arrangement, the fluid outlet may be provided in the end wall with the fluid inlet being provided in the sidewall. In this way, access to the fluid inlet may be enhanced and the inlet does not interfere with the collapse of the flexible container in use of the reservoir. A set of lids with sidewalls of different length may be provided for assembly with a common flexible container whereby reservoirs of different volume may be produced by selection of the appropriate lid.

In a still further arrangement, the reservoir includes a sleeve extending between and connecting the lid and flexible container. With this arrangement, the fluid outlet may be provided in the lid at the end of the reservoir with the fluid inlet being provided in the sleeve. A set of sleeves of different length may be provided for assembly with a common flexible container and lid such that the volume of the reservoir may be altered by selection of the appropriate sleeve. Also, the reservoir may be assembled without the sleeve if a fluid inlet is not required. Alternatively, the lid may be provided with a fluid inlet as described previously.

The liquid may be filtered to remove unwanted solid particles when filling the reservoir. Alternatively, the reservoir may include a filter for removing unwanted solid particles from the liquid supplied to the apparatus via the fluid outlet. Where a filter is provided in the reservoir, the fluid inlet is arranged to introduce liquid into the reservoir on the opposite side of the filter to the fluid outlet. In this way, fluid added to the reservoir via the fluid inlet must pass through the filter before reaching the fluid outlet. As a result, unwanted solid particles, i.e. contaminants, introduced with the liquid added to the reservoir are retained within the reservoir and thrown away with the container and lid.

Preferably, the fluid inlet comprises an opening closed by a removable closure such as a screw cap. The opening may be provided in a tubular spout portion projecting from the reservoir with the screw cap releasably secured thereto. In this way, the cap can be unscrewed to open the fluid inlet so that liquid can be added to the reservoir when required and the cap re-attached to close the inlet to continue spraying without removing the reservoir from the apparatus.

According to another aspect of the present invention, there is provided a spray gun for spraying paint-like materials comprising a spray nozzle for spraying a liquid, a collapsible reservoir for the liquid, the reservoir having a fluid outlet releasably connected to the spray gun whereby, after use, the reservoir can be detached and discarded, and the reservoir further having a fluid inlet arranged to be directly accessible when the reservoir is attached to the gun for adding liquid to the reservoir.

The spray gun may be of the gravity fed or pressure fed type.

According to a further aspect of the present invention, there is provided a reservoir for supplying a liquid to a spray gun or the like, the reservoir having a fluid outlet and a separate fluid inlet, the reservoir being adapted for releasable connection of the fluid outlet to the spray gun such that the fluid inlet is directly accessible for introducing liquid to the reservoir while attached to the spray gun, wherein the reservoir is collapsible when liquid is withdrawn therefrom in use of the spray gun.

The reservoir may be pre-filled with liquid to be sprayed with the fluid inlet permitting liquid to be added to the reservoir in use without detaching the reservoir from the spray gun. Alternatively, the reservoir may be supplied empty for the user to fill with the liquid of their choice.

According to a still further aspect of the present invention, there is provided a reservoir for attaching to a spray gun, the reservoir having a fluid outlet for supplying liquid to the spray gun and a separate fluid inlet for introducing liquid to the reservoir, the fluid outlet being formed in an end wall of the reservoir and the fluid inlet being formed in a sidewall of the reservoir so as to be accessible when the fluid outlet is attached to the spray gun.

The end wall may be a lid of the reservoir and the sidewall may be a skirt integral with the lid or a separate sleeve connected to the lid so that the fluid inlet is directly accessible when the reservoir is connected to the spray gun. Preferably, the sidewall extends between and connects the end wall to a flexible container for the liquid that is collapsible as the liquid is withdrawn from the reservoir in use. In this way, the fluid inlet does not interfere with collapsing of the container in use.

According to yet another aspect of the present invention, there is provided a reservoir for attaching to a spray gun, the reservoir having a fluid outlet for supplying liquid to the spray gun and a separate fluid inlet for introducing liquid to the reservoir, the fluid outlet being formed in an end wall of the reservoir and the fluid inlet being formed in the end wall offset from the fluid outlet so as to be accessible when the fluid outlet is attached to the spray gun.

The fluid outlet may be arranged on the central longitudinal axis of the reservoir but more preferably the fluid outlet is offset to one side of the longitudinal axis. The offset arrangement provides more room to accommodate the fluid inlet which can be made larger to facilitate filling the reservoir through the fluid inlet.

The fluid outlet may extend parallel to the longitudinal axis of the reservoir but more preferably the fluid outlet is inclined relative to the longitudinal axis. The angled arrangement increases the clearance between the spray gun and the fluid inlet thereby improving access to the fluid inlet when the reservoir is attached to the spray gun so that filling the reservoir through the inlet is easier.

Preferably, the fluid inlet is directly accessible when the reservoir is connected to the spray gun. Preferably, the reservoir includes a collapsible container for the liquid and the end wall is provided by a lid arranged to close an open end of the container.

According to a still further aspect of the present invention, there is provided a reservoir for attaching to a spray gun, the reservoir having a container for a liquid, a lid for closing the container, the lid having a fluid outlet connectable to a spray gun, and a volume adaptor between the container and the lid.

The volume adaptor may be an integral part of the lid, for example a dependent skirt, or it may be separate from the lid and container, for example a sleeve insertable between the lid and container. In this way, the same container can be adapted to provide the reservoir with any desired volume by selection and fitment of the appropriate adaptor.

The adaptor may include a fluid inlet for adding liquid to the reservoir while attached to the spray gun. For example, the adaptor may be provided with a removable closure for the fluid inlet.

The invention will now be described in more detail, by way of example only, with reference to the accompanying drawings, wherein:

DETAILED DESCRIPTION

Figure 1:
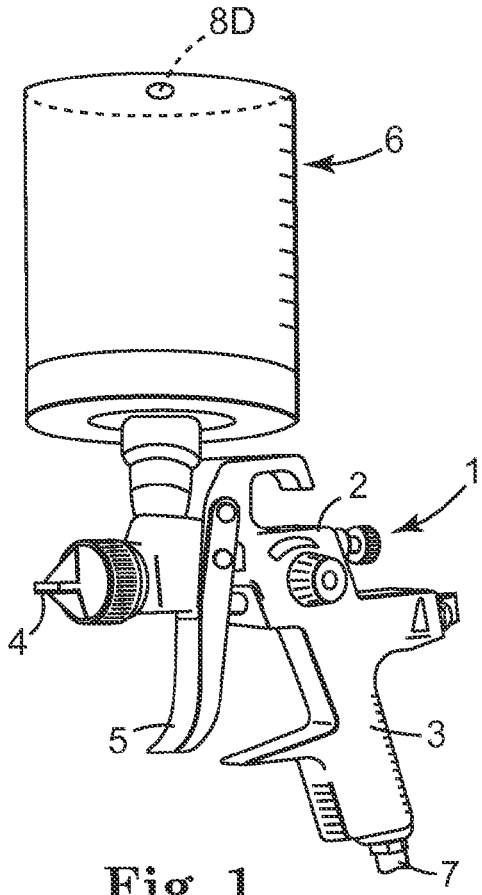
FIG. 1 is a perspective view of a prior art spray gun.

FIG. 1 of the drawings illustrates a prior art paint spray gun 1 of the gravity-feed type disclosed in our co-pending patent application published under No: WO 98/32539 the contents of which are incorporated herein by reference.

The gun 1 comprises a body 2, a handle 3 which extends downwards from the rear end of the body, and a spray nozzle 4 at the front end of the body. The gun 1 is manually-operated by a trigger 5 which is pivotally-mounted on the sides of the gun.

A paint reservoir 6, which contains paint (or similar material) to be discharged by the gun, is located on the top of the body 2 and communicates with an internal passageway (not visible) which extends through the gun to the nozzle 4.

In use, the gun 1 is connected via a connector 7 at the lower end of the handle 3 to a source of compressed air (not shown) so that, when the user pulls on the trigger 5, compressed air is delivered through the gun to the nozzle 4. As a result, paint delivered under gravity from the paint pot 6 to the nozzle 4 is atomised on leaving the nozzle 4 and forms a spray with the compressed air emerging from the nozzle 4.

Figure 3:
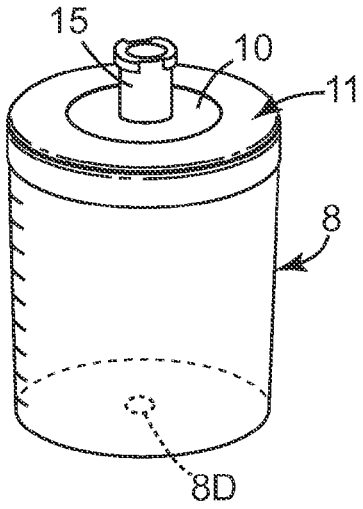
FIG. 3 is a perspective view of the assembled paint reservoir shown in FIG. 2.
Figure 4:
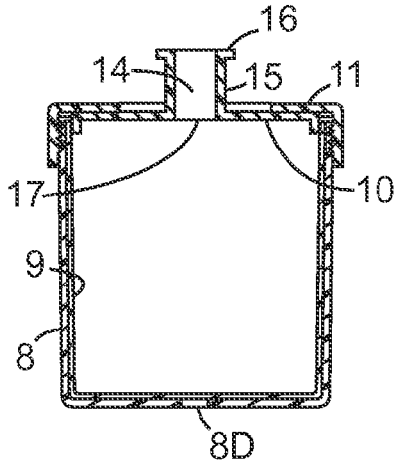
FIG. 4 is a longitudinal section through the paint reservoir shown in FIG. 3.
Figure 2:
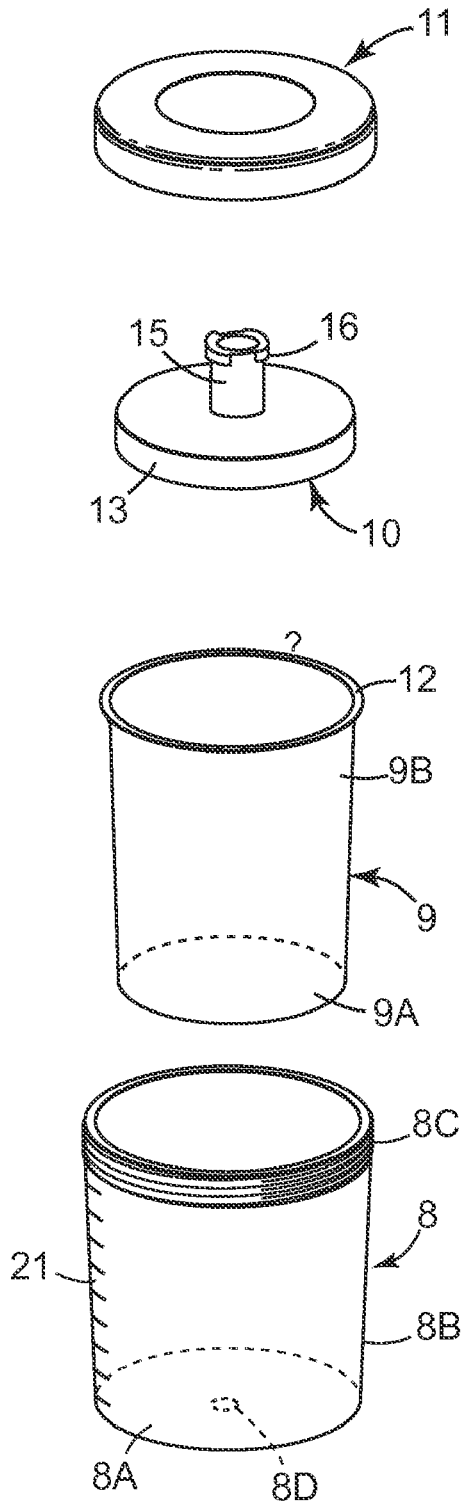
FIG. 2 is an exploded isometric view of the component parts of the paint reservoir shown in FIG. 1.

Referring now to FIGS. 2 to 4 of the drawings, the paint pot 6 includes an outer container 8, a disposable inner container 9, a disposable lid 10, and a collar 11. The inner container 9 corresponds in shape to (and is a close fit in) the interior of the outer container 8 and has a narrow rim 12 at the open end which sits on the top edge of the container 8.

The lid 10 has a dependent skirt 13 which is a push-fit in the open end of the inner container 9 and a central aperture 14 from which extends a connector tube 15 forming a fluid outlet. The tube 15 is provided at its free end with outward extensions 16 forming one part of a bayonet connection. The aperture 14 is covered by a filter mesh 17 which may be a push fit into the aperture 14 or may be an integral part of the lid 10.

The skirt 13 is inset from the outer edge of the lid 10 and the rim 12 of the inner container 9 is trapped between the end of the outer container 8 and the outer edge of the lid 10. The lid 10 is held firmly in place on the container 8 by the annular collar 11 that screws onto the container 8 on top of the lid 10. In the assembled condition, the inner container 9 and lid 10 form a reservoir for containing the paint or other liquid to be delivered to the nozzle 4 via the connector tube 15.

Figure 6:
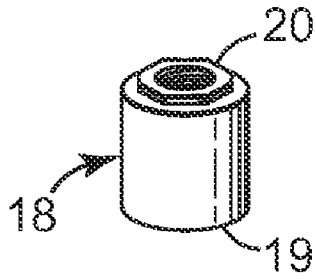
FIG. 6 is a perspective view of an adapter for connecting the paint reservoir to the spray gun.
Figure 7:
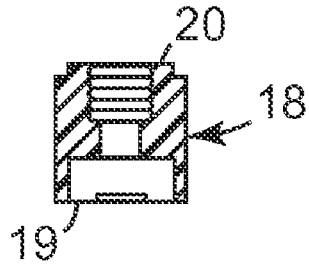
FIG. 7 is a longitudinal section through the adapter shown in FIG. 6.

The paint pot 6 is attached to the spray gun 1 through use of an adapter 18 shown separated from the paint pot 6 in FIG. 6. The adapter 18 is a tubular component which is formed internally at one end 19 with the other part of the bayonet connection for attachment to the connector tube 15 of the lid 10. At the other end 20, the adapter 18 is shaped to match the standard attachment of the spray gun paint pot (typically a screw thread).

The container 8 of the paint pot 6 is formed from a plastic material, for example polyethylene or polypropylene, and may be translucent (as shown in FIG. 2) or opaque, and of any suitable size. For use with a paint spray gun, containers 8 having a capacity of 250, 500 or 800 ml could typically be used, although other sizes could be used if required.

In this embodiment, the container 8 is of generally cylindrical shape closed at one end 8A. The other end is open and side wall 8B is formed with an external screw thread 8C. Base 8A is flat so that the container 8 can stand unsupported on a flat surface and is formed with a central air hole 8D. Internally, the side wall 8B tapers inwardly slightly from the open end to the base 8A.

The inner container 9 is preferably transparent and is thermo-formed from a single piece of plastics material, preferably polyethylene or polypropylene. The shape of the inner container 9 is dictated by and matches the internal shape of the container 8. The inner container 9, like the inside of the container 8, is of generally cylindrical shape closed at one end 9A and side wall 9B tapers inwardly slightly from the mouth towards the closed end 9A.

The rim portion 12 and base or closed end 9A are comparatively rigid but the side walls 9B are flexible and can be made to collapse. Nevertheless, the inner container 9 is capable of standing, unsupported, on the base 9A with side walls 9B extended and upright as shown in FIGS. 2 to 4.

Figure 5:
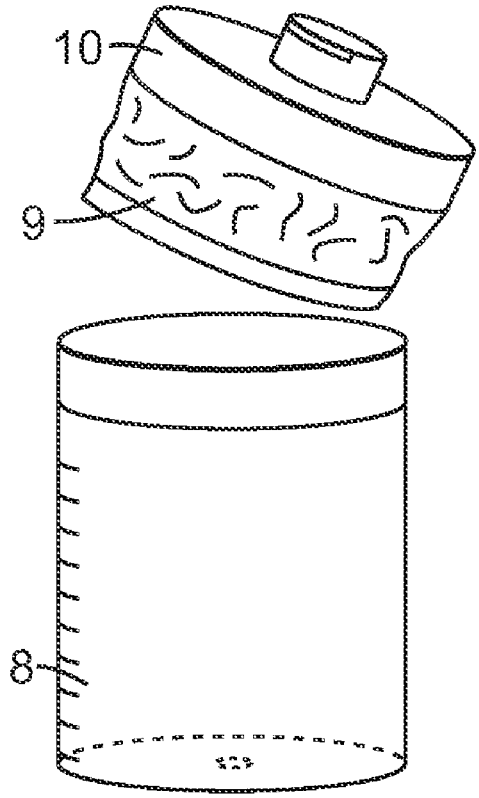
FIG. 5 shows separation of the component parts of the paint reservoir of FIG. 3 after use.

When the inner container 9 collapses, the comparatively rigid base 9A retains its form but moves towards the rim portion 12 as a consequence of the collapse of the side walls 9B, as illustrated in FIG. 5. The side walls 9B collapse in a similar fashion to a plastic bag without being ruptured (e.g. by splitting, tearing or cracking).

In one form, the inner container 9 has a height of about 110 mm, a diameter at its base 9A of about 78 mm and a diameter at its mouth (excluding the rim portion 12) of about 86 mm. The base 9A has a thickness of about 400 μm, the rim portion 12 has a thickness of about 900 μm, and the side walls 9B have a thickness of about 150 μm.

In another form, the inner container 9 has the same height and the same diameters at its base 9A and mouth but the base 9A has a thickness of about 300 μm, the rim portion 12 has a thickness of about 200 μm and the side walls 9B have a thickness in the range of from 50 to 250 μm.

The lid 10 is also formed from a plastic material, for example, polyethylene or polypropylene, and may be formed by an injection moulding process. The lid 10 may be translucent or opaque and may be coloured. The collar 11 may be a moulded plastic component, or it may be a machined metal (for example, aluminium) component. The adapter 18 may be a metal or plastic component and may, for example, be formed from aluminium and anodised or plated.

To use the paint pot 6, the adapter 18 is attached at the end 20 to the spray gun and is left in position. Then, with the paint pot 6 disassembled as shown in FIG. 2, the inner container 9 is pushed inside the outer container 8. Paint is then put into the inner container 9 and, if necessary, mixed with other tinters, hardeners and thinners (solvents). The lid 10 is then pushed into place and the collar 11 is screwed down tightly to hold the lid 10 in position.

The top portion of the inner container 9 is then trapped between the skirt 13 of the lid 10 and the sidewall 8B of the container 8, and the rim 12 of the inner container 9 is trapped between the top edge of the container 8 and the collar 11 as shown in FIG. 4.

The spray gun 1 is then inverted from its normal operating position illustrated in FIG. 1. The end of the connector tube 15 can then be attached to the adapter 18 without spilling the paint contained in the reservoir by a simple push/twist action to engage the co-operating bayonet formations. The spray gun 1 can then be returned to its normal operating position for use in the usual way.

As paint is removed from within the inner container 9, the sides 9B of the inner container 9 collapse as a result of the decreased pressure within the inner container 9. The base 9A of the inner container 9, being more rigid, retains its shape so that the inner container 9 tends to collapse in the longitudinal rather than the transverse direction thereby reducing the possibility of pockets of paint being trapped in the inner container 9.

The user can choose to evacuate the air from within the inner container 9 before operating the spray gun 1 although that is not essential. It does, however, increase the range of angles at which the spray gun 1 will function satisfactorily since there is no risk of air entering the spray gun 1 from the paint pot 6. To evacuate the air from within the inner container 9, the trigger 5 of the spray gun 1 should be actuated while the spray gun 1 is still in the inverted position.

After use, when the spray gun 1 is to be cleaned, the spray gun 1 can be re-inverted from its operating position shown in FIG. 1. The airline is disconnected and the trigger 5 actuated briefly to allow paint within the spray gun 1 to drain back into the inner container 9 in the pot 6. The pot 6 is then removed from the spray gun 1 by disengaging the bayonet formations and detaching the connector tube 15 from the adapter 18 which remains on the spray gun 1.

As will be appreciated, the bayonet formations provide a connector system that enables the pot 6 to be quickly connected to and removed from the spray gun 1 with a simple push-twist action requiring less manual dexterity than a threaded connection. It will be understood, however, that any other type of connector system may be employed to releasably connect the pot 6 to the spray gun 1.

The collar 11 is removed from the outer container 8, and the lid 10 is then pulled out, bringing with it the collapsed inner container 9 as shown in FIG. 5. The lid 10 (including the filter 17) and inner container 9 are discarded, leaving the outer container 8 and collar 11 clean and ready for re-use with a fresh inner container 9 and lid 10. Only the spray gun 1 itself needs to be cleaned, resulting in a substantial reduction in the amount of solvent used.

The risk of unused paint spilling from the pot 6 is also substantially reduced because the inner container 9 is removed and discarded in a somewhat collapsed condition with the lid 10 in place. Moreover, because the inner container 9 is discarded in a collapsed condition, the amount of space required for collection of used inner containers 9 is minimised.

Because the inner container 9, as described above, is an accurate fit inside the outer container 8 and has a smooth internal surface, it is possible to mix paint in the inner container 9 within the outer container 8 rather than in a separate receptacle. In that way, cleaning of a separate mixing receptacle can also be eliminated to achieve a further reduction in the amount of solvent used.

The general shape of the outer container 8 and, in particular the fact that it is flat-bottomed and stable when in the orientation shown in FIG. 2, makes it particularly suitable for mixing paint in the inner container 9 supported within the container 8.

The possibility of the inner container 9 being punctured or damaged by the mixing implement is minimised. First because the inner container 9 fits inside the outer container 8 exactly and, second, because the self-supporting nature of the inner container 9 means that it is less likely to be dragged around inside the outer container 8 during the mixing process.

To facilitate the use of the inner container 9 as a mixing receptacle, the outer container 8 is translucent and the sidewall 8B provided with markings 21 (FIG. 2) for indicating the volume of the contents of the inner container 9. Alternatively, if the outer container 8 is opaque, it could be formed with slots in the sidewall 8B through which the inner container 9 could be viewed to enable the user of the spray gun 1 to assess the amount of paint in the pot 6 at any time.

When paint is mixed in the inner container 9, the inclusion of the filter mesh 17 in the lid 10 prevents unwanted particles in the paint from entering the spray gun 1. The mesh 17 can be omitted, however, if the paint is textured, or if it is mixed in a separate receptacle and strained when it is transferred to the inner container 9 or if the presence of contaminants in the paint is unimportant.

As will be apparent from the foregoing description, the arrangement of the disposable inner container 9 and lid 10 to form a reservoir containing the paint or other liquid to be sprayed, considerably reduces the amount of cleaning required when changing the liquid to be sprayed or when putting the spray gun 1 away at the end of the working day.

It can happen, however, that the area to be painted requires a larger volume of paint than the reservoir can hold. In these circumstances, the user has to remove the pot 6 from the spray gun 1, release the collar 11 and remove the lid 10 to allow the reservoir to be topped up. The lid 10 then has to be relocated on the open end of the inner container 9, the collar 11 refitted and the pot 6 reattached to the spray gun 1 to enable the user to continue spraying. This is time consuming and there is a risk of paint being spilt and/or contaminated when the lid 10 is removed.

As an alternative to re-filling the reservoir, some users fill two or more reservoirs with the same liquid that can be fitted to the spray gun in turn when spraying large areas. Although, the user can change over the reservoirs and continue spraying with the same liquid, filling and assembling several reservoirs is time consuming and adds to operating costs. Thus, each reservoir has a disposable inner container and lid which is discarded after spraying and using several reservoirs for the same liquid is wasteful of such disposable items and requires the user to have available a sufficient number of pots and collars for assembly of the reservoirs.

Referring now to FIGS. 8 to 12 of the drawings, there is shown a first embodiment of the present invention that enables the user to add paint to the reservoir while attached to the spray gun. For convenience, like reference numerals in the series 100 are used throughout to indicate parts corresponding to FIGS. 1 to 7 and the construction and operation of similar parts will be understood from the description above and will not be further described in detail.

Figure 8:
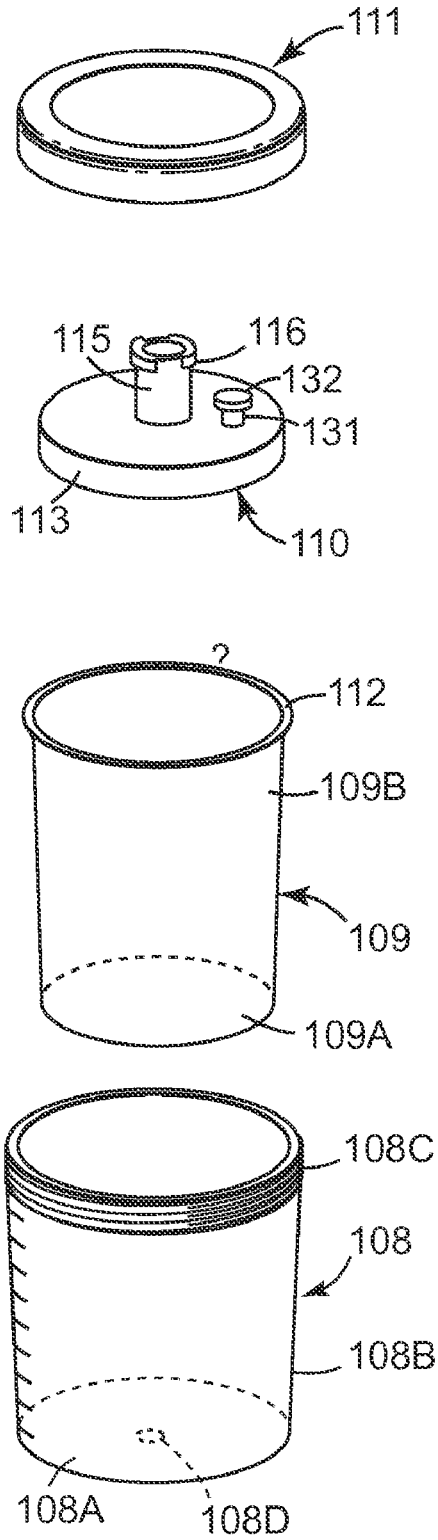
FIG. 8 is an exploded isometric view similar to FIG. 2 showing the component parts of a paint reservoir according to a first embodiment of the invention.
Figure 9:
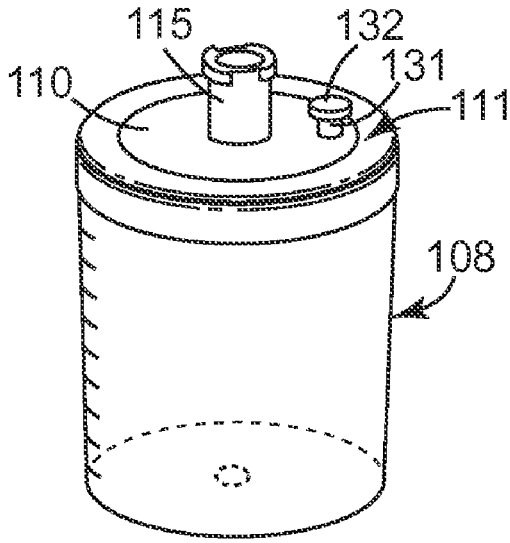
FIG. 9 is a perspective view similar to FIG. 3 showing the assembled paint reservoir of FIG. 8.
Figure 10:
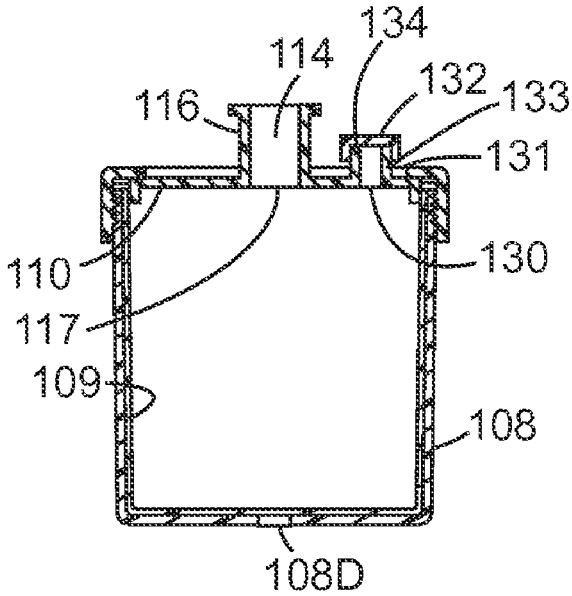
FIG. 10 is a longitudinal section through the paint reservoir of FIG. 9.

As shown in FIGS. 8 to 10, the paint pot 106 comprises outer container 108, inner container 109, lid 110 and collar 111. In accordance with the present invention, the lid 110 is provided with an opening 130 offset from the central connector tube 115. The opening 130 is bounded by an external tubular spout portion 131 providing a fluid inlet that is closed by a removable cap 132 screwed onto the tubular spout portion 131.

The tubular spout portion 131 is formed integrally with the lid 110 and has an external screw thread 133 for engagement by an internal screw thread 134 of the cap 132. In this way, the cap 132 can be removed to allow access to the reservoir through the opening 130 in the lid 110 and re-secured to close the opening 130. The screw cap 132 provides a simple method of opening and closing the fluid inlet to allow liquid to be introduced into the reservoir. It will be understood, however, that any arrangement for introducing liquid to the reservoir may be employed which enables the fluid inlet to be opened and closed when required.

Figure 11:
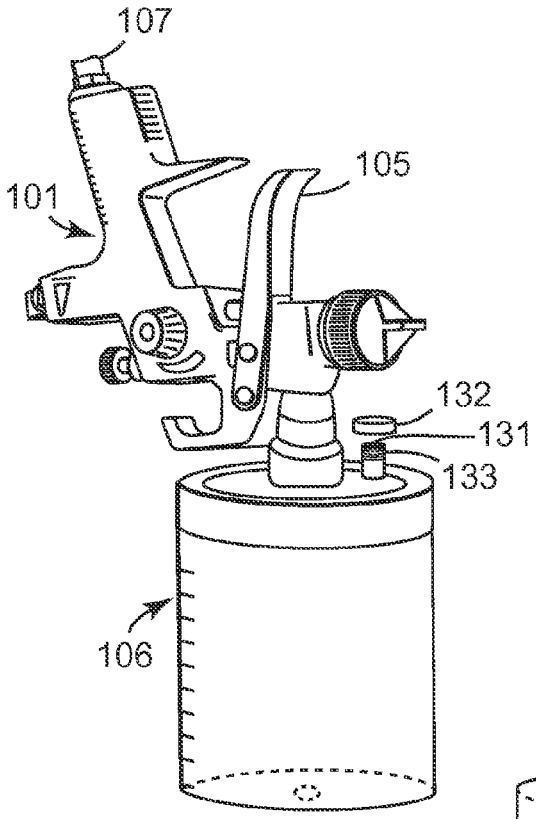
FIG. 11 is a perspective view showing the reservoir of FIGS. 8 to 10 attached to the spray gun of FIG. 1 with the spray gun shown inverted and the closure cap removed for adding paint to the reservoir.
Figure 12:
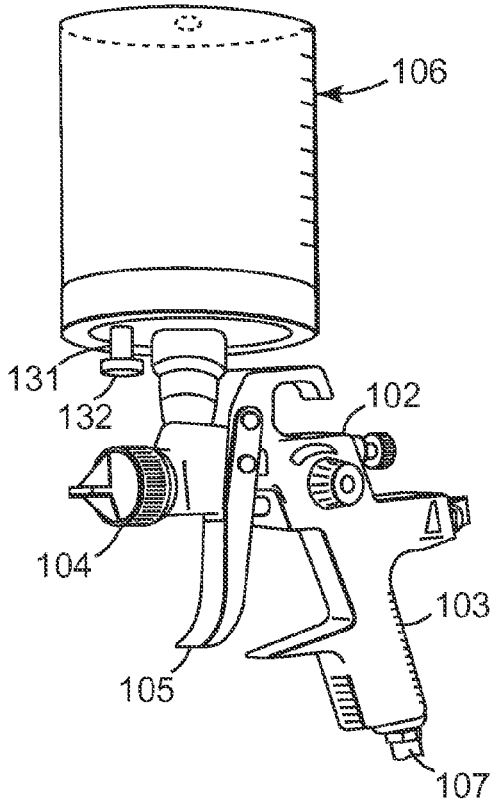
FIG. 12 is a perspective view of the spray gun shown in FIG. 11 re-inverted and ready for use.

With reference now to FIGS. 11 and 12, the tubular spout portion 131 is arranged so that, when the pot 106 is secured to the spray gun 101 and the spray gun 101 is inverted from its normal operating position, the fluid inlet is at the upper end of the reservoir (FIG. 11). In this way, the cap 132 can be removed and paint or other liquid added to the reservoir through the fluid inlet without removing the pot 106 from the spray gun 101. The cap 132 can then be re-attached and the spray gun 101 re-inverted to its normal operating position to allow the user to continue spraying (FIG. 12). The addition of liquid to the reservoir may be facilitated by the use of a funnel to reduce the risk of spillage, for example when pouring paint from another container. Alternatively, the spout portion 131 may be extended by attaching a flexible tube to facilitate addition of liquid to the reservoir via the fluid inlet.

When it is desired to change the liquid in the reservoir, the pot 106 is detached from the spray gun 101, and the inner container 109 and lid 110 removed as a complete assembly and thrown away as described above. A new, clean, inner container 109 can then be fitted in the pot 106 and filled with the new liquid either before or after fitting the lid 110 and securing the collar 111. The pot 106 can then be attached to the spray gun 101 and, in use, if the reservoir needs to be topped up, this can be done via the fluid inlet by removing the cap 132 as described above.

Figure 13:
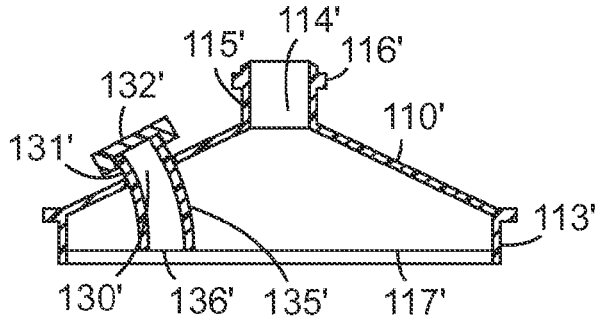
FIG. 13 is a longitudinal section of an alternative lid and filter for the reservoir shown in FIGS. 8 to 12.

Referring now to FIG. 13, this shows an alternative form of lid 110' and filter 117' for use with the inner container 109 of the previous embodiment. The lid 110' is of conical shape and the filter 117' comprises a flat mesh screen that is push-fit within the skirt 113' and is held in place by compression so as to extend across the open end of the inner container 109 when the skirt 113' is inserted into the inner container 109. This arrangement increases the surface area of the filter 117' compared to the previous embodiment in which the filter 117 fits over the end of the connector tube 115. As a result, flow of paint is improved. In a modification (not shown), the mesh screen is mechanically held in place by engagement of the marginal edge of the screen with a rib, groove or similar locating formation on the inside of the skirt 113'.

In accordance with the present invention, the lid 110' is provided with an opening 130' in the conical wall offset from the connector tube 115'. The opening 130' is bounded by external tubular spout portion 131' on which closure cap 132' is releasably secured. The tubular portion 131' extends at an angle away from the connector tube 115' towards the peripheral edge of the lid 110'. As a result, access for adding paint is enhanced.

In this modification, the opening 130' is above the filter 117' and the lid 110' is formed with an integral internal tubular spout portion 135' extending from the opening 130' to an aligned opening 136' in the filter 117'. In this way, paint added to the reservoir via the opening 130' passes directly into the reservoir without having to pass through filter 117'. As a result, if the paint contains any particles or the like, these are removed by the filter 117' and cannot pass through the connector tube 115' in use of the spray gun 101.

Figure 14:
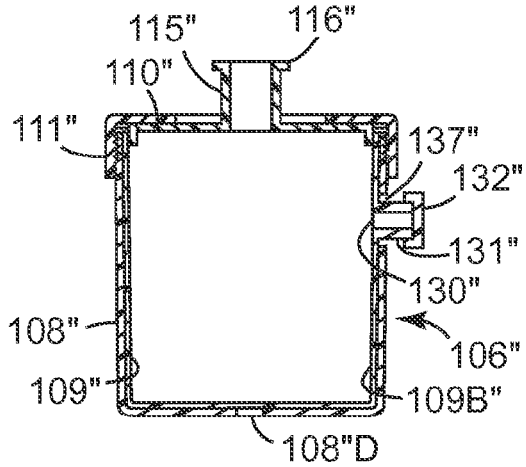
FIG. 14 is a longitudinal section showing an alternative location of the fluid inlet and closure cap for the reservoir shown in FIGS. 8 to 12.

Referring now to FIG. 14, this shows an alternative location for the opening 130" for adding paint to the reservoir with the pot 106" attached to the spray gun 101. The opening 130" is provided in the sidewall 109B" of the inner container 109" and the outer container 108" is provided with an opening 137" through which tubular spout portion 131" extends to attach the closure cap 132". The inner container 109" can be collapsed to allow the tubular spout portion 131" to be inserted through the opening 137" from within the container 108". The cap 132" may then be attached or the opening may be large enough to allow the spout portion 131" to be inserted with the cap 132" already attached.

This arrangement of the fluid inlet on the side of the pot 106" provides relatively free access to the cap 132" when it is desired to add paint to the reservoir. Preferably, the fluid inlet is provided at the upper end of the inner container 109" as shown. In this way, it does not to interfere significantly with collapsing of the reservoir when paint is withdrawn during spraying. Furthermore, when it is desired to add paint to the reservoir with the pot 106" attached the spray gun 101, the reservoir can be filled up to the level of the opening 130" without spilling.

Figure 15:
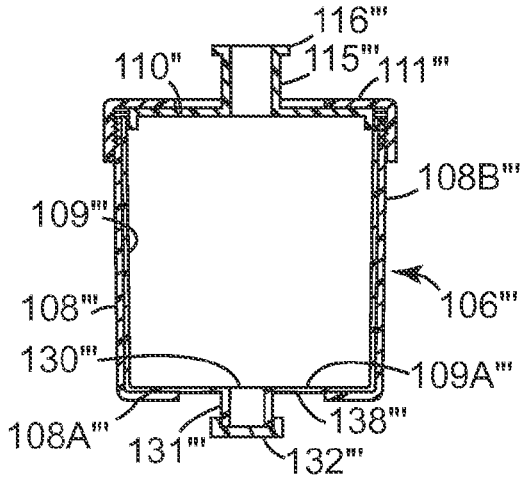
FIG. 15 is a longitudinal section showing yet another location of the fluid inlet and closure cap for the reservoir shown in FIGS. 8 to 12.

With reference now to FIG. 15, this shows yet another possible location for the opening 130'" for adding paint to the reservoir with the pot 106'" attached to the spray gun 101. The opening 130'" is provided in base 109A'" of the inner container 109'" and the outer container 108'" is provided with an opening 138'" in the base through which tubular spout portion 131'" can extend. In this case, the opening 138'" must be large enough for the cap 132'" to pass freely through so as not to interfere with collapsing of the inner container 109'" when paint is withdrawn from the reservoir.

With this arrangement, paint may be added to the reservoir with the pot 106'" attached to the spray gun 101 and the spray gun 101 in its normal operating position, i.e. the spray gun 101 does not have to be inverted. When re-filling the reservoir, the collapsed or partially collapsed inner container 109'" may have to be manually extended The sidewalls 108B'" of the container 108'" may be extended below the base 108A'" to allow the pot 106'" to stand on a flat surface with the inner container 109'" inserted and the tubular portion 131'" extending through the opening 138'" in the base 108A'". Alternatively, the outer container 108'" may comprise sidewalls 108B'" only with no base wall.

Figure 16:
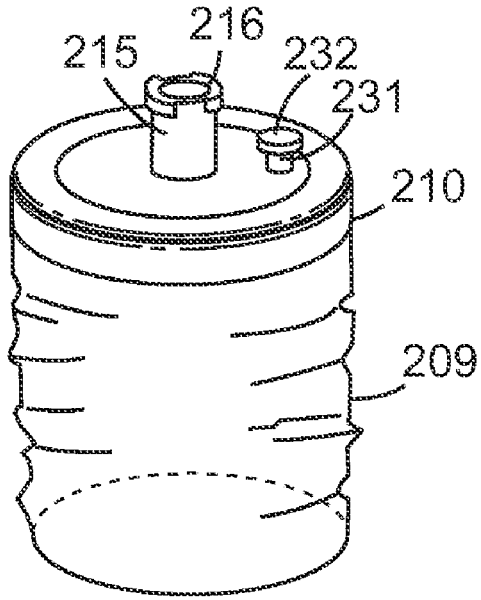
FIG. 16 is a perspective view of a paint reservoir according to a second embodiment of the invention.
Figure 17:
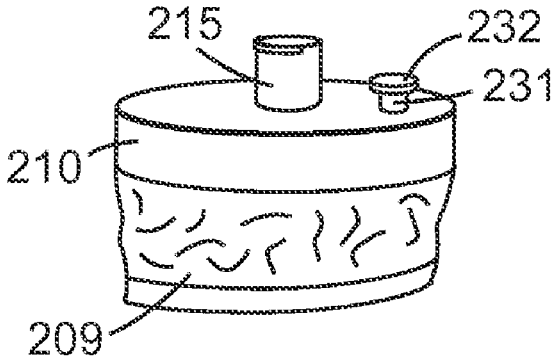
FIG. 17 shows the paint reservoir of FIG. 16 in a collapsed condition.

Referring now to FIGS. 16 and 17, a second embodiment of the present invention is shown for adding paint or other liquid to the reservoir while attached to the spray gun. For convenience, like reference numerals in the series 200 are used throughout to indicate parts corresponding to the previous embodiment and the construction and operation of similar parts will be understood from the description above and will not be further described in detail.

In this embodiment, the inner container 209 is permanently attached to the lid 210 which has a fluid outlet connectable to the spray gun and a fluid inlet for adding paint to the reservoir.

For example, the lid 210 may be bonded to the inner container 209 by adhesive or by welding.

This arrangement enables the construction of the reservoir to be simplified compared to the previous embodiment. In particular, the outer container for receiving the inner container 209 and the collar for securing the lid 210 are no longer required for assembly of the reservoir and can be dispensed with.

In this embodiment, the materials employed for the container 209 and lid 210 are similar to the previous embodiment. It will be understood, however, that this is not essential. Thus, the container 209 can be constructed from any material that is resistant to tearing, ripping or rupturing and which collapses as paint is being withdrawn. For example, the container 209 may be made of metal foil and/or metal foil may be incorporated into a plastic laminate to provide the required characteristics for the container 209.

The assembly of lid 210 and container 209 may be pre-filled with a liquid and supplied to the user for attaching to the spray gun 1 via the connector tube 215 on the lid 210. The reservoir can then be refilled while still attached to the spray gun 1 via the fluid inlet by removing the cap 232. Pre-filling may be employed for liquids that can be packaged and stored until required without degrading. Thus, pre-filling may be especially useful for liquids that can be supplied ready to use (i.e. without requiring modification to match the colour to an existing colour). For example, base coats in standard colours and/or primers or lacquers that can be supplied in a non-activated form and activated (if necessary) by suitable means such as by exposure to a source of light (ultraviolet) or electrical energy when required.

Alternatively, the assembly of lid 210 and container 209 may be supplied empty for the user to fill with liquid via the fluid inlet with the cap 232 removed. This enables the user to use either standard liquids or liquids that have been specially mixed to match a particular colour. Again, the reservoir can be refilled in use while attached to the spray gun 1.

Where the assembly of container 209 and lid 210 is supplied empty, the container 209 may be collapsed thereby reducing the space required for packing and transportation of the assembly by the manufacturer and the space required for storing the assembly until required by the end user. Where the assembly is supplied and stored in the collapsed condition, the container 209 can be returned to its original shape prior to adding the chosen liquid.

In this embodiment, the lid 210 and container 209 are permanently secured together and the reservoir is sufficiently stable for attaching to the spray gun without any additional support. For some applications, however, it may be desirable or necessary depending on the size and/or materials employed for the container 209 to provide support for the container 209 when the reservoir is attached to the spray gun.

Figure 18:
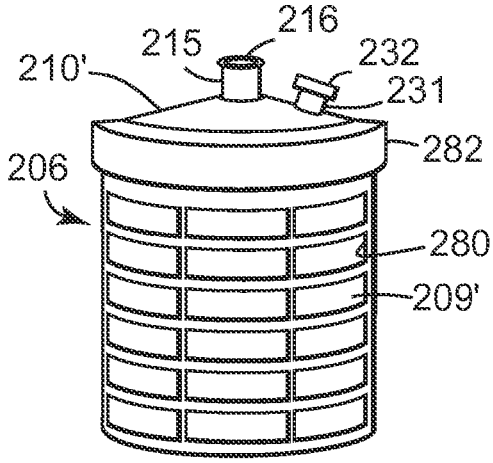
FIG. 18 shows a modification to the paint reservoir shown in FIG. 16 to include a support cage.
Figure 19:
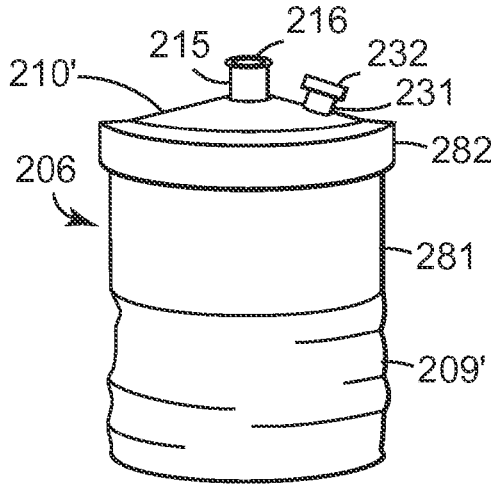
FIG. 19 shows an alternative support cage for the paint reservoir shown in FIG. 16.

FIGS. 18 and 19 show two support cages 280 and 281 that can be employed to support the reservoir as the container 209 collapses. The cages 280, 281 are made of plastics material that combine the necessary strength with lightness for ease of handling the spray gun to which the reservoir with the cage 280, 281 is attached. It will be understood, however, that other materials may be employed.

In FIG. 18, the cage 280 provides support over the whole length of the container 209' and is in the form of an open mesh that allows visual inspection of the reservoir as the container 209' collapses. In FIG. 19, the cage 281 provides support over part of the length of the container 209' and is in the form of a short tube that may be transparent to allow visual inspection of the reservoir as the container collapses. It will be understood however that any suitable design of cage may be employed that adequately supports the container 209'. For example, the cage may comprise a plurality of downward extending leg portions for guiding the container to collapse in the longitudinal direction.

In FIGS. 18 and 19, the cage 280, 281 is separate from the lid 210' and container 209' and is secured by an annular collar 282 that fits over the lid 210'. It will be understood, however, that the cage could be formed as an integral part of the lid 210'.

It will also be understood that the cage 280, 281 and collar 282 are not limited to arrangements in which the lid 210' and container 209' are permanently attached together. Thus, the cage 280, 281 and collar 282 may be used in any of the arrangements according to the first embodiment in which lid and container are separate components to secure the lid and container together and provide support for the reservoir as the container collapses.

Figure 20:
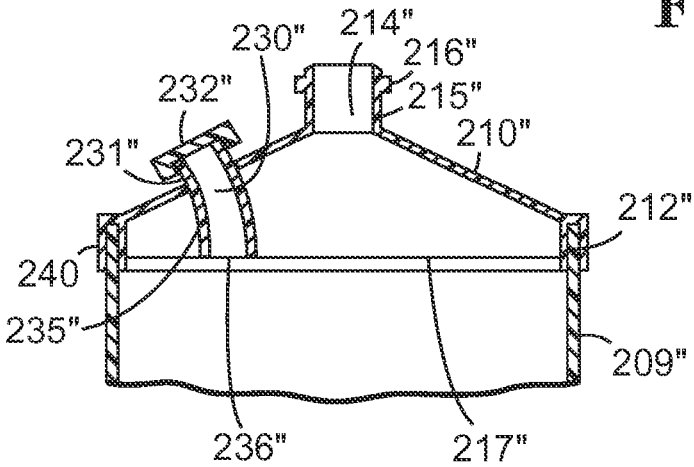
FIG. 20 shows a modification of the paint reservoir shown in FIG. 16.
Figure 21:
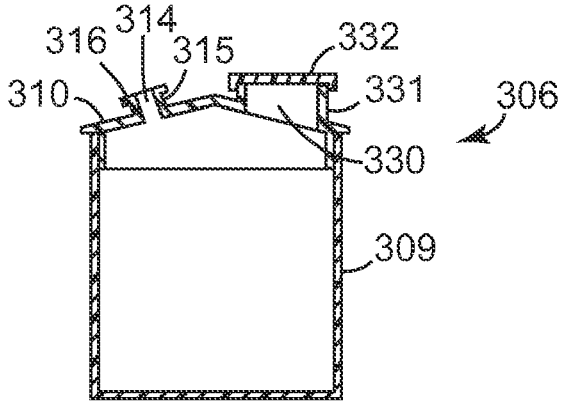
FIG. 21 is a longitudinal section of a paint reservoir according to a third embodiment of the invention.
Figure 22:
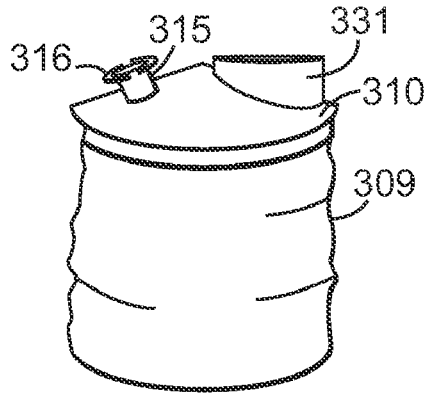
FIG. 22 is a perspective view of the paint reservoir of FIG. 21 with the closure cap removed.
Figure 23:
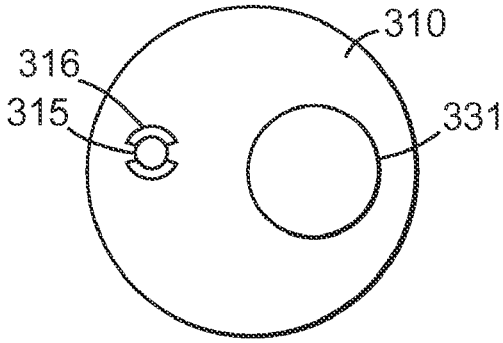
FIG. 23 is a plan view of the paint reservoir of FIG. 21.

Referring now to FIG. 20, an alternative arrangement is shown for permanently uniting the lid 210" and container 209" in which an annular groove 240 is provided in the underside of the lid 210" to receive the rim 212" of the container 209". The rim 212" and groove 240 are provided with complementary interlocking formations to seal the lid 210" on the container 209" and prevent the container 209" separating from the lid 210". This assembly may be carried out during manufacture for supply of the lid 210" and container 209" pre-filled with liquid or empty as described above. Alternatively, the lid 210" and container 209" may be supplied separately for assembly by the user. This arrangement may be provided with a support cage for the container as described above. The cage may be a separate component or formed integrally with the lid 210". For example, the outer wall of the groove 240 may be extended axially to surround the container 209" over all or part of the length of the container 209".

Referring to FIGS. 21 to 24, there is shown a third embodiment of the present invention for adding paint to a reservoir while attached to a spray gun. For convenience, like reference numerals in the series 300 are used throughout to indicate parts corresponding to previous embodiments and the construction and operation of similar parts will be understood from the description above and will not be further described in detail.

In this embodiment, the end wall of the lid 310 is of conical shape and the connector tube 315 is offset from the centre of the lid 310 and extends at an angle to the central longitudinal axis of the lid 310. This offset arrangement allows the size of the opening 330 to be increased compared to the previous embodiments. As shown, the opening 330 has a diameter of slightly less than half the diameter of the lid 310. It will be understood, however, that the size of the opening 330 may be altered from that shown.

As will be appreciated, increasing the size of the opening 330 allows faster filling/refilling of the reservoir formed by attaching the lid 310 to the container 309. Furthermore, a removable "drop in" sock filter can be used in conjunction with the opening 330 to filter paint poured into the reservoir. As a result, there is no need to employ a filter over the aperture 314 of the connector tube 315 when the reservoir is connected to a spray gun.

Figure 24:
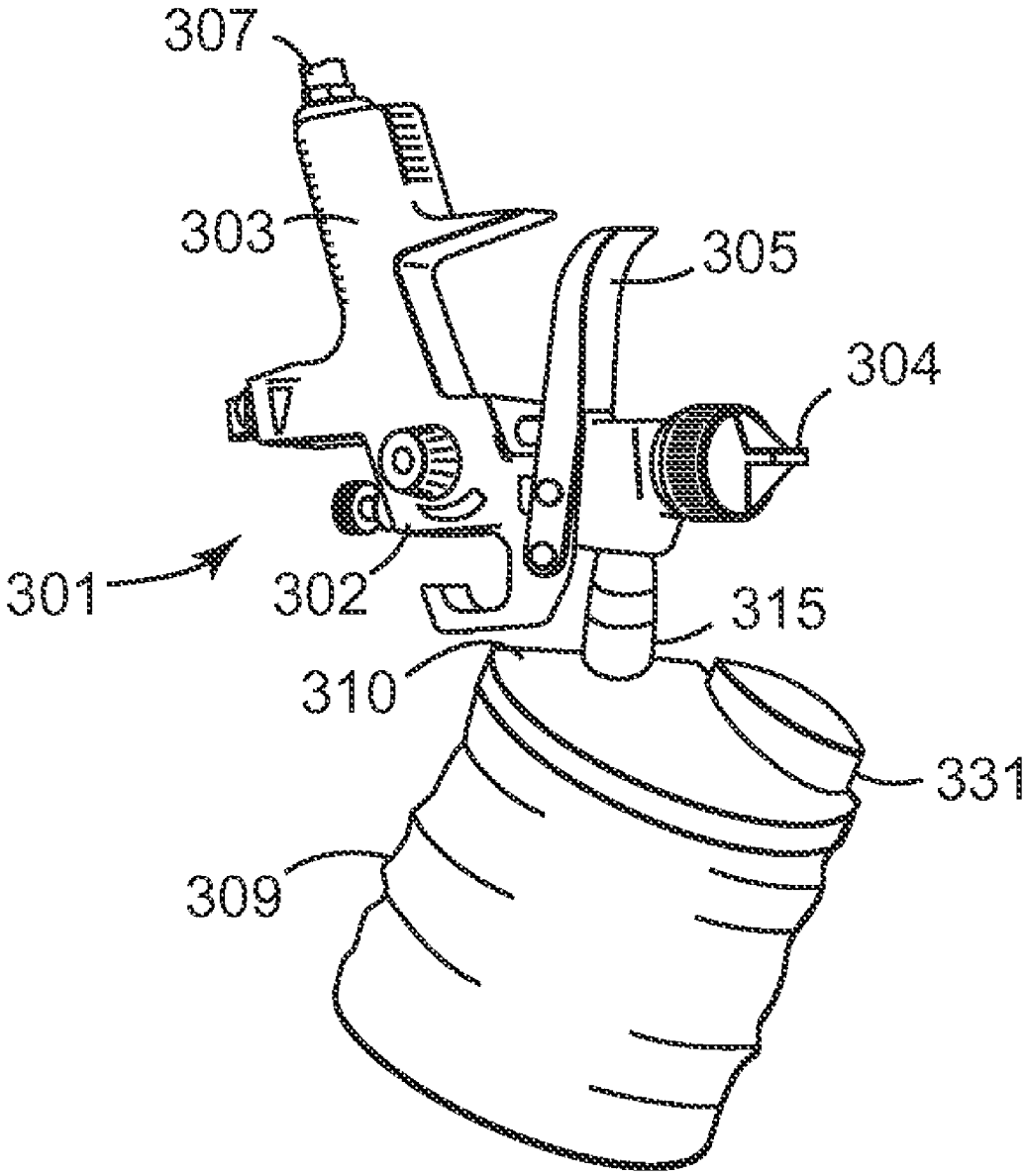
FIG. 24 is a perspective view showing the paint reservoir of FIGS. 21 to 23 connected to the spray gun of FIG. 1 with the spray gun shown inverted and the closure cap removed for adding paint to the reservoir.

Furthermore, as shown in FIG. 24, access to the opening 330 when the reservoir is attached to the spray gun 301 and the spray gun 310 is inverted for adding paint to the reservoir is enhanced by the offset arrangement of the connector tube 315 extending at an angle relative to the longitudinal axis of the opening 330. As a result, the opening 330 is clear of the spray gun 301 and paint can be introduced more easily to the reservoir through the opening 330 with the reservoir attached to the spray gun. This contributes further to faster filling of the reservoir with reduced risk of spillage.

Depending on the starting/finishing positions of the bayonet formations 316 for securing the reservoir to the spray gun 301, the offset arrangement of the connector tube 315 may result in the reservoir overhanging to one side of the spray gun 301. This could have an adverse effect on the handling of the spray gun 301. In particular, the spray gun 301 may be unbalanced making it more awkward to manoeuvre and making access for spraying more difficult where available space is restricted.

Accordingly, the bayonet formations 316 are arranged so that, when the reservoir is connected to the spray gun 301, it is aligned along the spray axis of the spray gun 301. In this way, unbalance due to the reservoir overhanging to one side is avoided. Additionally, the inclination of the connector tube 315 to the longitudinal axis of the reservoir may be chosen so that the reservoir is arranged at an optimum angle to the spray gun to best suit working requirements. In this way, any adverse effects resulting from the offset arrangement of the connector tube 315 on handling of the spray gun 301 are overcome or at least mitigated.

In this embodiment, the container 309 is permanently attached to the lid 310 by adhesive, welding or any other suitable method as described previously in connection with the second embodiment of the invention. It will be understood, however, that the advantages from offsetting the connector tube 315 and increasing the size of the filler opening 330 may be applied to any of the other lid/container combinations described herein. For example, the lid may be separate from the container and secured by a collar as described in connection with the first embodiment. Furthermore, it will be appreciated the offset arrangement of the connector tube 315 and increased size of the filler opening 330 may be applied to any shape of lid. For example, the lid may have a flat end wall as shown in FIGS. 8 to 17 or a conical end wall as shown in FIGS. 18 to 24.

Figure 25:
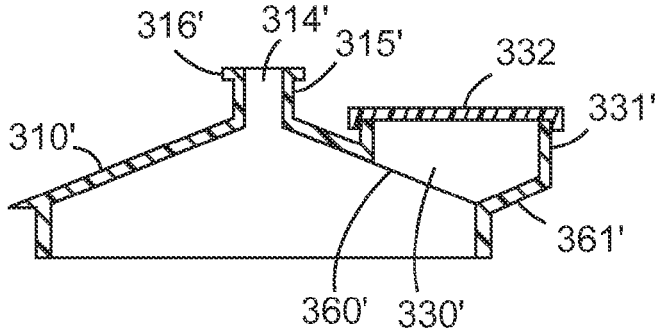
FIG. 25 is a longitudinal section of an alternative lid for the paint reservoir shown in FIG. 21.
Figure 26:
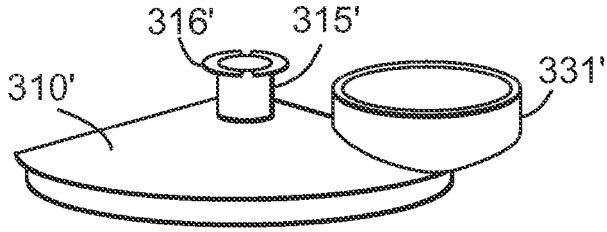
FIG. 26 is a perspective view of the lid shown in FIG. 25 with the closure cap removed.
Figure 27:
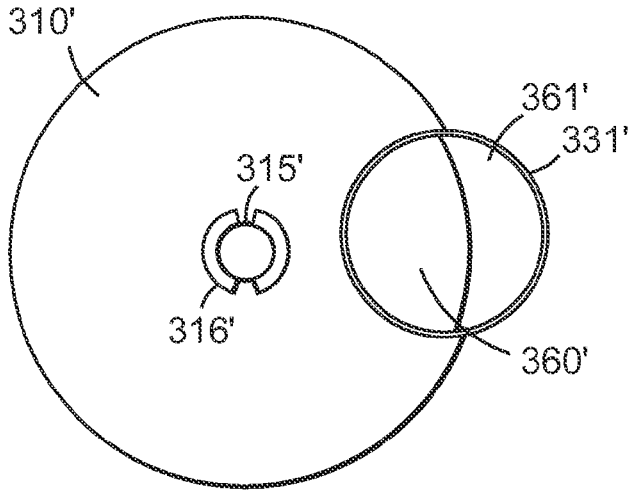
FIG. 27 is a plan view of the lid shown in FIG. 25.

Referring now to FIGS. 25 to 27, an alternative arrangement for increasing the size of the filler opening 330' in the lid 310' to facilitate filling/re-filling the reservoir according to the third embodiment of the invention is shown. The connector tube 315' is positioned at the apex of the conical end wall of the lid 310' aligned with the central longitudinal axis of the lid 310'. As a result, the reservoir does not overhang to one side of the spray gun irrespective of the start/finish position of the bayonet formations 316' for securing the reservoir to the spray gun. To accommodate the increased size of the filler opening 330' without restricting access when the reservoir is attached to the spray gun, the spout 331' is arranged to overhang the rim of the lid 310' on one side. The wall of the spout 331' that overhangs the rim of the lid 310' is formed with an angled portion 361' that directs paint towards and through a substantially D-shaped aperture 360' leading into the reservoir at the base of the opening 330'.

The lid 310' may be permanently attached to the container 309' as described previously or it may be separate from the container 309' and secured by a suitably shaped collar as described previously.

Figure 28:
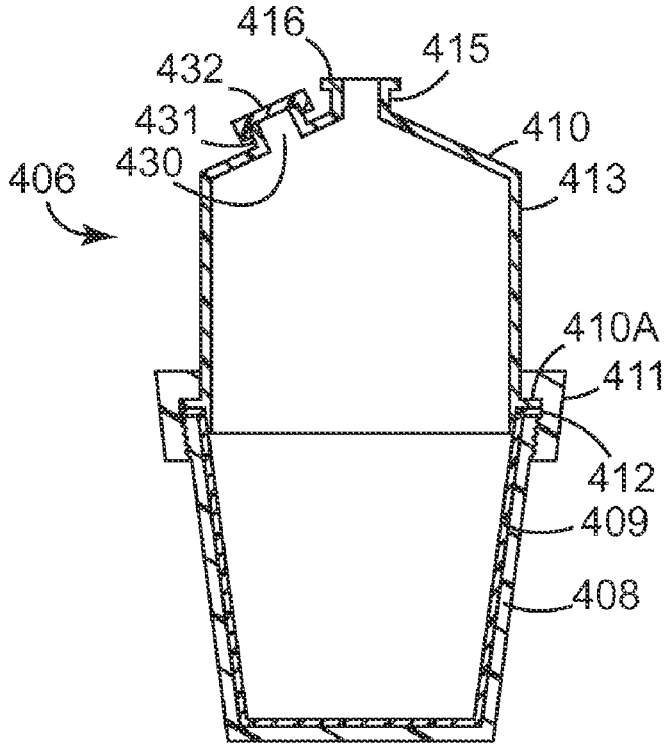
FIG. 28 is a longitudinal section of a paint reservoir according to a fourth embodiment of the invention.
Figure 29:
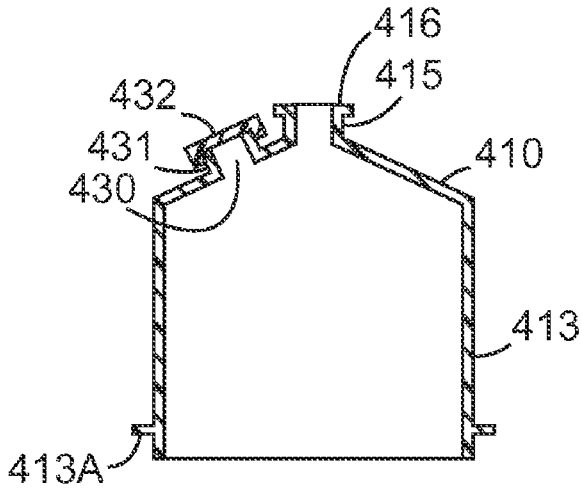
FIG. 29 is a longitudinal section of the lid of the paint reservoir shown in FIG. 28.
Figure 30:
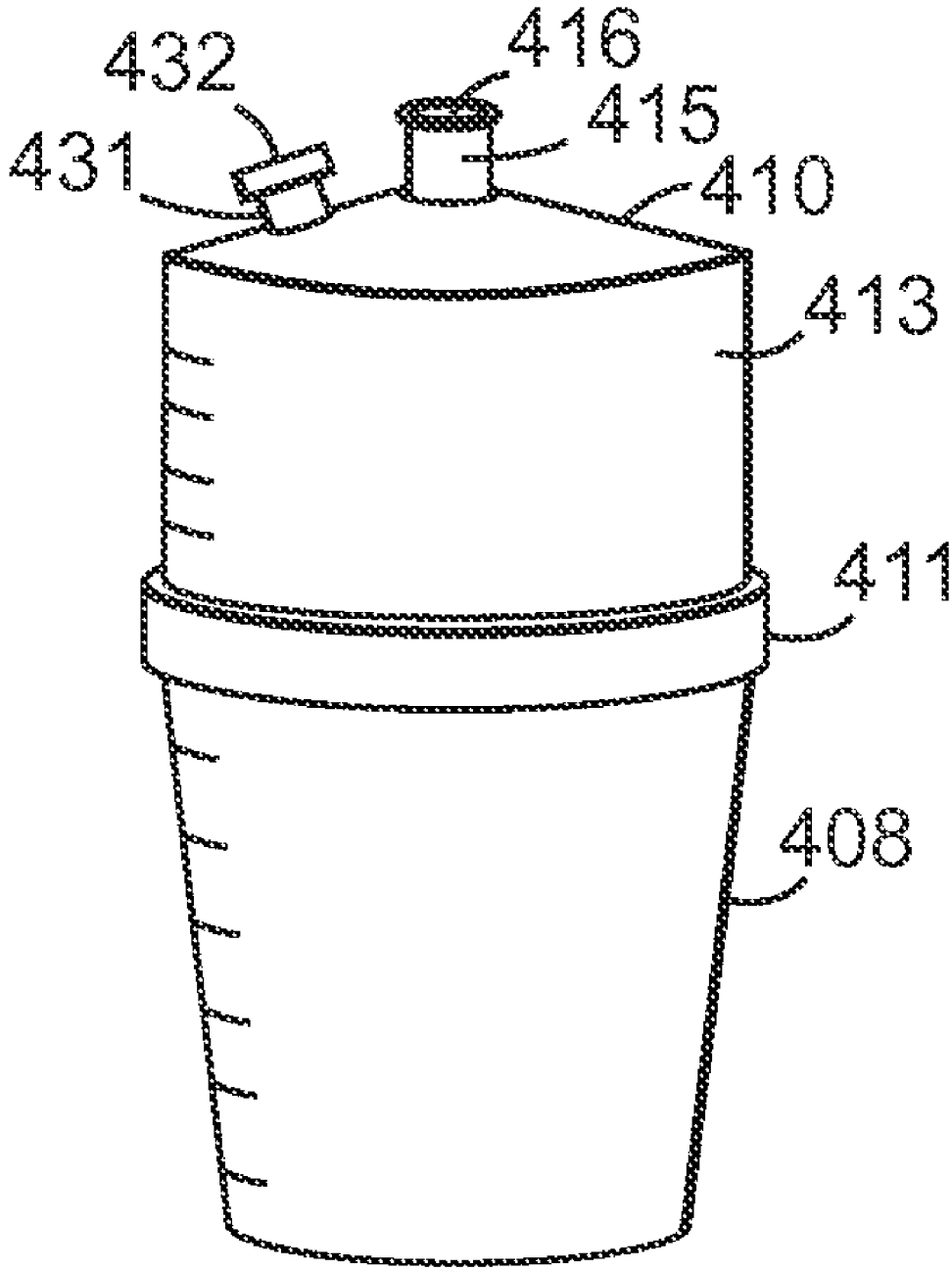
FIG. 30 is a perspective view of the paint reservoir shown in FIG. 28.

Referring now to FIGS. 28 to 30, a fourth embodiment of the present invention for adding paint to a reservoir while attached to a spray gun is shown. For convenience, like reference numerals in the series 400 are used throughout to indicate parts corresponding to previous embodiments and the construction and operation of similar parts will be understood from the description above and will not be further described in detail.

In this embodiment, the inner container 409 is received in outer container 408 to locate the rim portion 412 over the outer end of the container 408. The lid 410 has an elongated skirt 413 of cylindrical shape integral with the end wall of the lid 410. The free end of the skirt 413 is a push fit in the open end of the inner container 409 to trap the rim portion 412 of the inner container 409 between the end of the container 408 and an external lip 413A integral with the skirt 413.

The end wall of the lid 410 is of conical shape and is provided with the connector tube 415 and filler opening 430 for filling/refilling the reservoir while connected to the spray gun as described for the previous embodiment. In this embodiment, the connector spout 415 is arranged on the central longitudinal axis of the lid 410 but it will be understood the lid 410 may be provided with any of the connector spout 415 and filler opening 430 arrangements previously described.

As will be appreciated, the elongated skirt 413 increases the volume of the reservoir and allows the spray gun to be used for large paint jobs without having to repeatably refill the reservoir with paint. Furthermore, the same combination of outer container 408 and inner container 409 may be assembled with lids 410 having different lengths of skirt 413 to provide reservoirs having a range of different volumes. In this way, the required volume reservoir for a particular job can be readily assembled by selecting the lid 410 having the appropriate size of skirt 413 and assembling the selected lid 410 with the same combination of outer container 408 and inner container 409. As a result, the number of components required to produce a range of reservoirs of different volume is reduced. More particularly, the use of different size inner containers 409 requiring different size outer containers 408 is avoided such that manufacture, supply, storing and assembly of components for assembly of reservoirs of different volume is facilitated.

In a modification (not shown), the filler opening 430 may be re-positioned from the end wall of the lid 410 and located in the skirt 413 where permitted by the length of the skirt 413. This may allow easier access to the filler opening 430 when the reservoir is connected to the spray gun.

Figure 31:
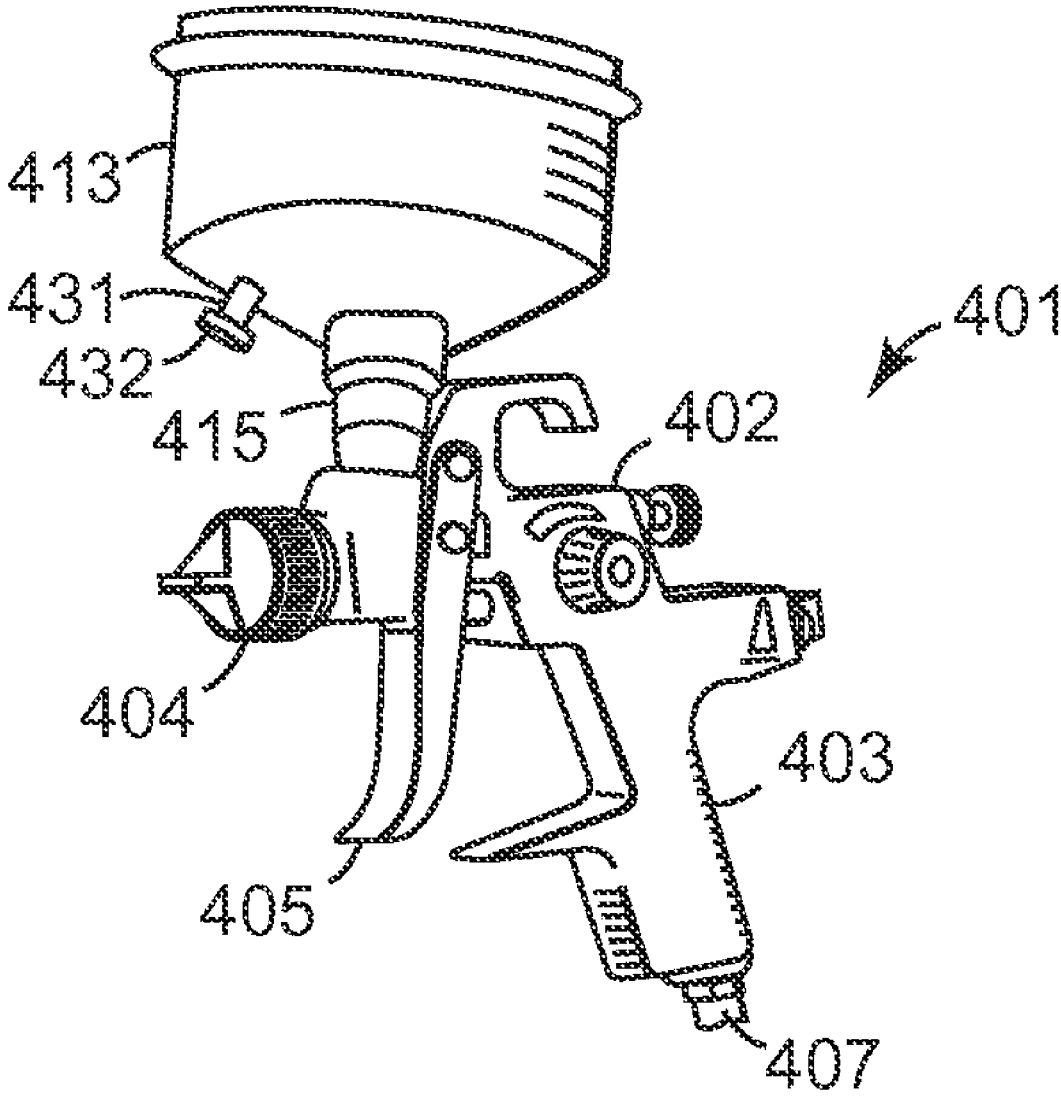
FIG. 31 is a perspective view showing the lid of FIG. 29 attached to a spray gun to form a reservoir for paint.

Referring now to FIG. 31, the lid 410 with elongated skirt 413 may be used by itself to provide a low volume reservoir for small repair jobs, for example spot repairs. This may result in cost savings by reducing the time taken to carry out a repair and by reducing the number of disposable components required for the repair from two to one where the lid 410 can be used without the inner container 409.

A vented cover (not shown) can be used to close off the open end of lid 410 with elongated skirt 413.

Figure 32:
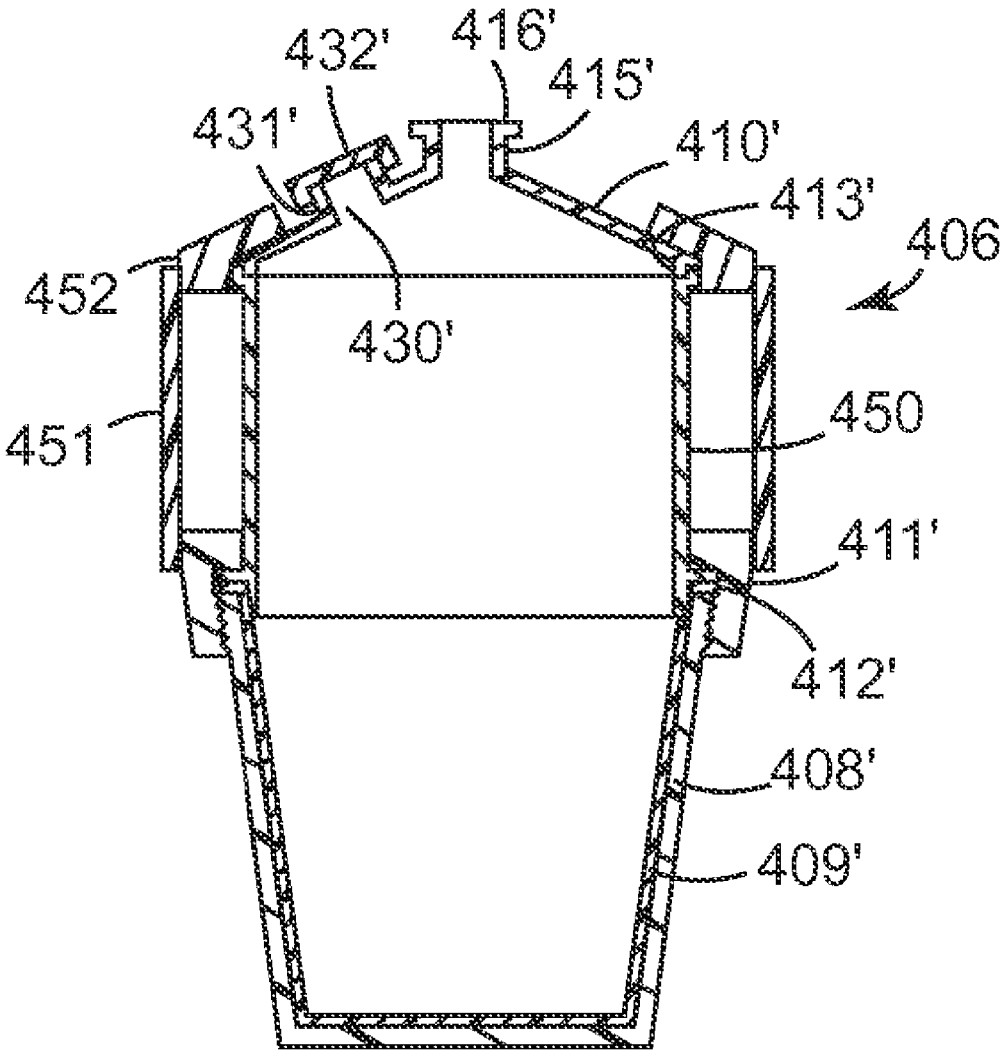
FIG. 32 is a longitudinal section showing a modification to the paint reservoir of FIG. 28.
Figure 33:
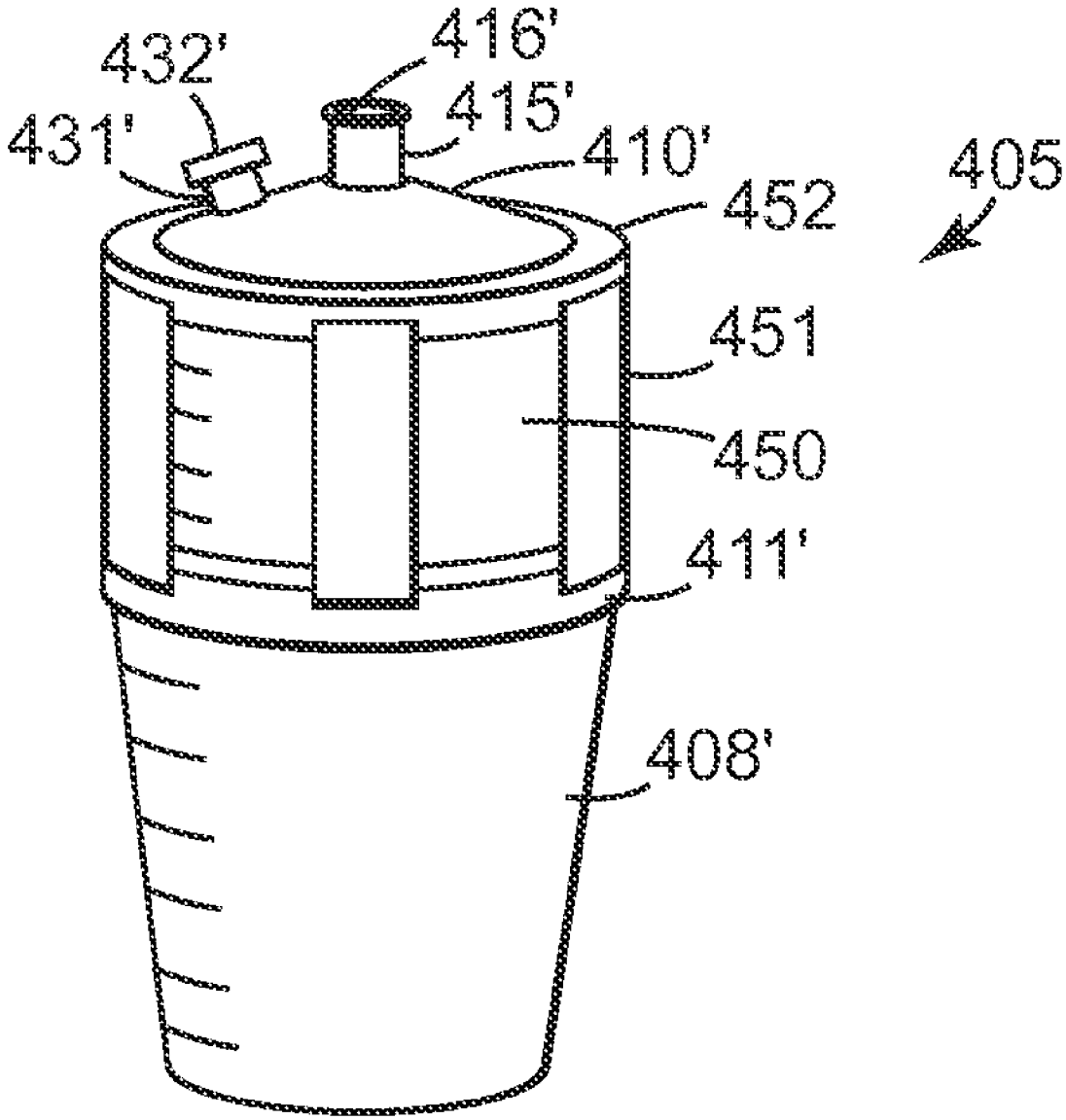
FIG. 33 is a perspective view of the paint reservoir shown in FIG. 32.

Referring now to FIGS. 32 and 33, an alternative arrangement is shown for varying the volume of the reservoir in which a separate sleeve 450 of cylindrical shape is provided between the lid 410' and inner container 409'.

As shown, the short skirt 413' on the underside of the lid 410' is a push fit in one end of the sleeve 450 to locate the outer edge of the lid 410' on the end of the sleeve 450. The other end of the sleeve 450 is a push fit in the open end of the inner container 409' to trap rim portion 412' of the inner container 409' between the end of the container 408' and an external lip 450A of the sleeve 450. Locking collar 411' is threadably engageable with the outer container 408 to secure the sleeve 450 relative to the inner container 410'. The locking collar 411' is connected via axially extending webs 451 to a retainer collar 452 that clamps the separate lid 410' to the sleeve 450 as the locking collar 411' is tightened.

As will be appreciated, the ends of the sleeve 450 are shaped to co-operate with the inner container 409' and lid 410' such that the inner container 410' and lid 409' can be assembled either with or without the sleeve 450 therebetween. In this way, the same inner container 409' and lid 410' combination can be assembled with or without sleeves 450 of different length to provide reservoirs having a range of different volumes.

More particularly, the lid 410' can be assembled directly to the inner container 409' where the reservoir only has to hold a small volume of paint. The same lid 410' and inner container 409' can also be assembled with an appropriately sized sleeve 450 therebetween to provide a reservoir capable of holding a larger volume of paint if required.

As a result, one size of inner container 409', lid 410' and outer container 408' can be employed for assembly with different sizes of sleeve 450 to produce any desired volume of reservoir. In this way, the volume of the reservoir can be altered as desired using common components that simplifies manufacture, supply, storage and assembly of the paint reservoir for a variety of different uses.

Figure 34:
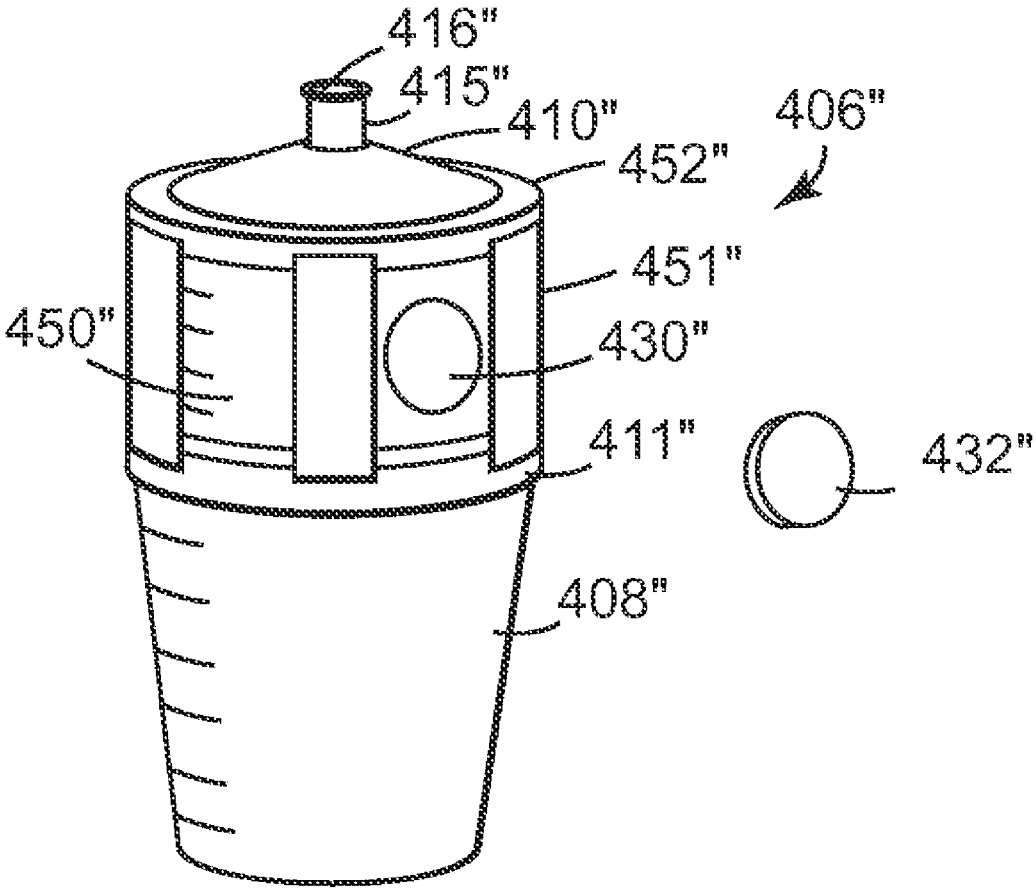
FIG. 34 is a perspective view, similar to FIG. 33, showing an alternative arrangement for the fluid inlet.

In the arrangement shown in FIGS. 32 and 33, the lid 410' is provided with the connector tube 415' and filler opening 430'. A modification of this arrangement is shown in FIG. 34 in which the filler opening 430" is re-positioned from the lid 410" to the wall of the extension sleeve 450". This may allow easier access to the filler opening 430" when it is desired to add paint to the reservoir. Also, manufacture of the lid 410" is simplified.

As will now be appreciated, the present invention provides apparatus for spraying a liquid having a collapsible reservoir connected to a spray gun wherein liquid can be added to the reservoir while it is attached to the spray gun. Other arrangements of the fluid inlet for adding liquid to the reservoir while attached to the spray gun will be apparent to those skilled in the art and are deemed within the scope of this invention.

It will also be appreciated that the exemplary embodiments described herein are intended to illustrate the diverse range and application of the invention and that features of the embodiments may be employed separately or in combination with any other features of the same or different embodiments.

Moreover, while the exemplary embodiments described and illustrated are believed to represent the best means currently known to the applicant, it will be understood that the invention is not limited thereto and that various modifications and improvements can be made within the spirit and scope of the invention as generally described herein.

Finally, as used herein, the term "liquid" refers to all forms of flowable materials that can be applied to a surface using a spray gun (whether or not they are intended to colour the surface) including (without limitation) paints, primers, base coats, lacquers, varnishes and similar paint-like materials as well as other materials such as adhesives, sealers, fillers, putties, powder coatings, blasting powders, abrasive slurries, mould release agents and foundry dressings which may be applied in atomised or non-atomised form depending on the properties and/or the intended application of the material and the term "liquid" is to be construed accordingly.

What is claimed is:

1. A spray gun for spraying a liquid comprising: a reservoir, the reservoir comprising an outer container, an inner container and a lid, a spray nozzle for dispensing liquid supplied from the reservoir, the lid of the reservoir having a fluid outlet connectable to the gun and a fluid inlet for adding liquid to the reservoir, the fluid inlet having a removable closure for opening and closing the fluid inlet, wherein the closure is directly accessible when the reservoir is connected to the gun such that liquid may be added to the reservoir without detaching the reservoir from the gun.

2. A spray gun according to claim 1, wherein the reservoir comprises a collapsible portion for the liquid to be supplied to the spray gun and an attachment portion provided with the fluid outlet for connecting the reservoir to the spray gun.

3. A spray gun according to claim 2 wherein the attachment portion is adapted for releasably connecting the fluid outlet to the gun.

4. A spray gun according to claim 3 wherein the attachment portion and gun are provided with co-operating formations for releasably securing the reservoir to the gun.

5. A spray gun according to claim 4 wherein the co-operating formations are engageable with a push-twist action.

6. A spray gun according to claim 2 wherein the inner container comprises a flexible container for the liquid and the lid is arranged to close an opening in the container.

7. A spray gun according to claim 6 wherein the lid is separate from the flexible container and means is provided for securing the lid to close the opening in the container.

8. A spray gun according to claim 6 wherein means is provided for supporting the flexible container.

9. A spray gun according to claim 6 wherein the lid has an end wall and a sidewall extending from the end wall, the sidewall being arranged to connect the lid to the flexible container.

10. A spray gun according to claim 1 wherein fluid inlet is provided with a spout and the removable closure comprises a screw cap releasably engageable with a threaded portion of the spout.

11. A spray gun according to claim 1 of the gravity fed or pressure fed type.

* * * * *